United States Patent [19]

Mincher

[11] Patent Number: 4,832,316

[45] Date of Patent: May 23, 1989

[54] WALL SECURITY FIXTURES

[76] Inventor: William H. Mincher, 2 Eden Road, Bramley, 2090, Johannesburg, Transvaal, South Africa

[21] Appl. No.: 46,835

[22] Filed: May 4, 1987

Related U.S. Application Data

[63] Continuation-in-part of Ser. No. 704,664, Feb. 25, 1985, abandoned.

[51] Int. Cl.[4] ..... E04H 17/16; B21C 37/02

[52] U.S. Cl. ..... 256/11; 256/22; 256/19; 72/379; 29/415

[58] Field of Search ..... 256/11, 19, 22, 59, 256/8, DIG. 5, 34, 73; 72/379, 337; 29/415

[56] References Cited

U.S. PATENT DOCUMENTS

| | | | |
|---|---|---|---|
| 367,893 | 8/1887 | Cloud | 256/65 X |
| 829,397 | 8/1906 | Gerber | 256/19 |
| 936,246 | 10/1909 | Josler | 256/22 |
| 1,319,290 | 10/1919 | Klein | 256/22 |
| 3,407,550 | 10/1968 | Shaw | 256/11 X |
| 3,411,753 | 11/1968 | Wood | 256/73 X |
| 3,822,461 | 7/1974 | Malmstrom | 29/415 |
| 3,972,510 | 8/1976 | Dougherty | 256/11 |
| 4,193,583 | 3/1980 | Witt | 256/11 |
| 4,625,948 | 12/1986 | Lustvee | 256/22 X |

FOREIGN PATENT DOCUMENTS

| | | | |
|---|---|---|---|
| 29939 | 10/1898 | United Kingdom | 256/22 |
| 2070095 | 9/1981 | United Kingdom | 256/59 |

*Primary Examiner*—Andrew V. Kundrat
*Assistant Examiner*—Peter M. Cuomo
*Attorney, Agent, or Firm*—Scully, Scott, Murphy & Presser

[57] ABSTRACT

A method of forming a wall security fixture of the kind having an elongate rail and a plurality of upstanding palings connected to the rail. In the method, a flat sheet of material is punched to form a series of flat, intermediate paling members which are located side-by-side in complementary relationship. The individual intermediate members are then folded about an axis of symmetry to form V-shaped palings which have outwardly splayed end portions which can be welded or otherwise fixed to the web of a channel-shaped rail to secure the paling to the rail. The invention extends to wall security fixtures formed according to the method.

15 Claims, 4 Drawing Sheets

FIG. 1
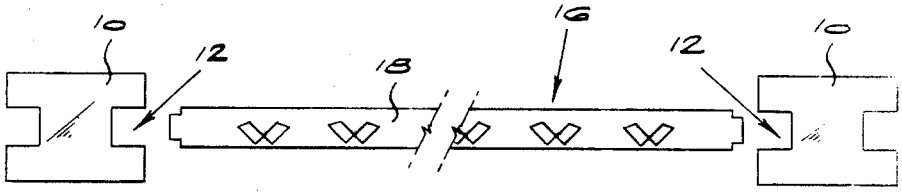
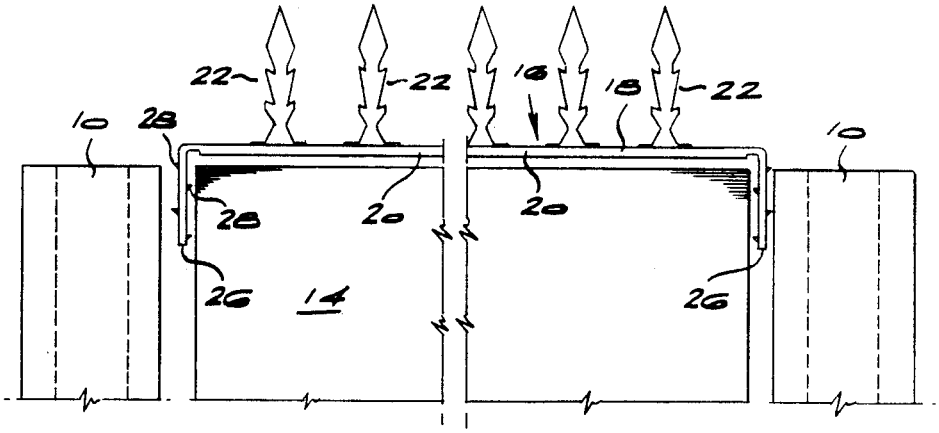
FIG. 2
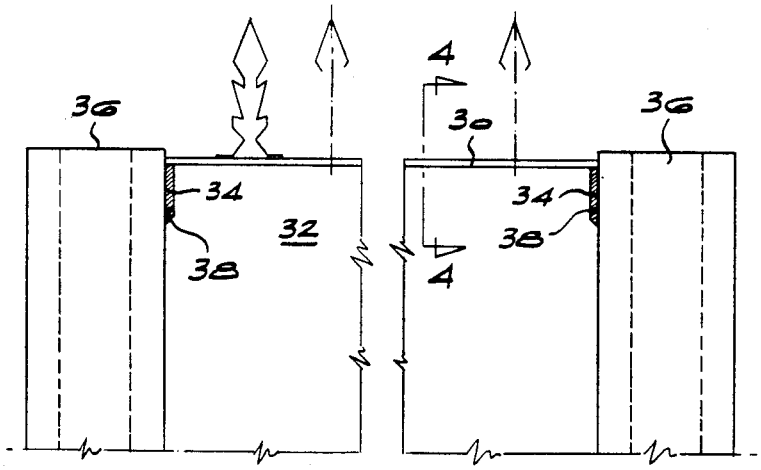
FIG. 3
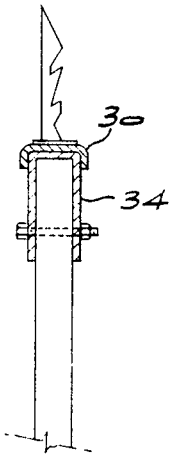
FIG. 4

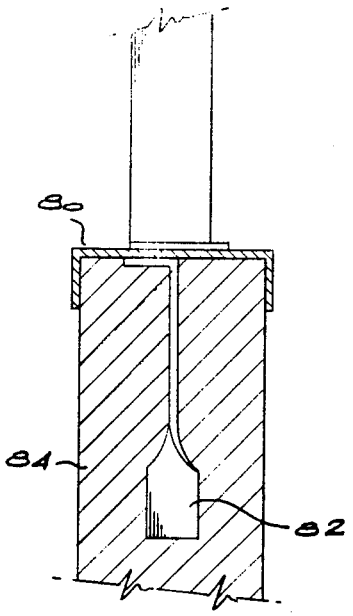
FIG 9
FIG 10
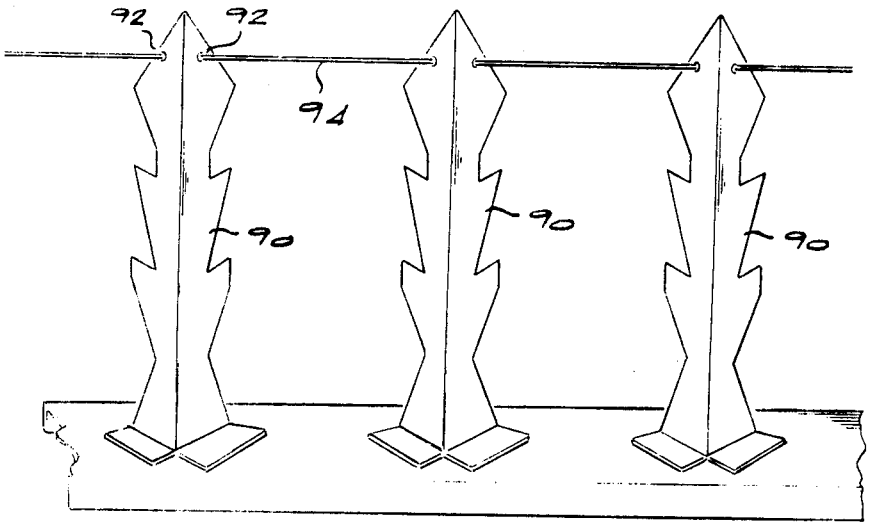

FIG. 11
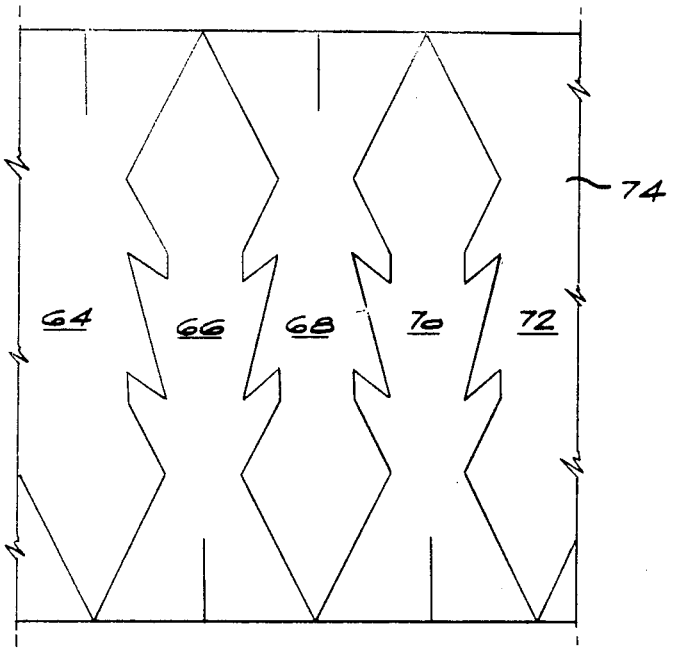
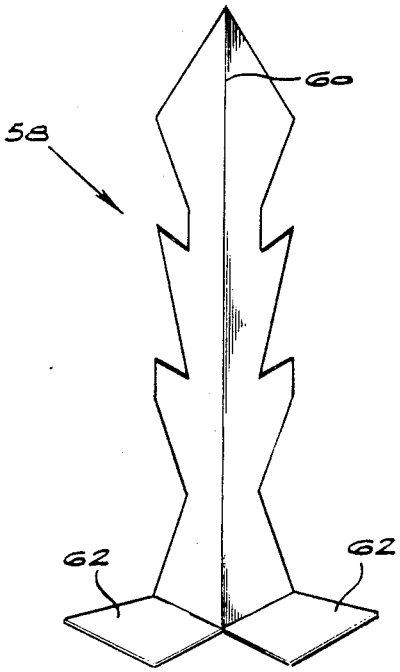
FIG. 12

WALL SECURITY FIXTURES

This application is a continuation-in-part of prior application Ser. No. 704,664, filed Feb. 25, 1985, now abandoned.

BACKGROUND TO THE INVENTION

This invention relates to wall security fixtures and in particular to fixtures for precast walls and brick walls.

Precast walls i.e. walls which employ a series of spaced, upright posts and concrete panels spanning between the posts are extremely popular. One major disadvantage from which they suffer is that it is a simple matter for an intruder to scale the wall and gain entrance to the walled area if the wall is not of great height. Some people have attempted to provide such walls with greater security by arranging barbed wire above the highest panel. While effective to some degree, the result is rather unsightly. The problem outlined above is not limited to precast walls only. The same problem also exists with brick walls.

This invention seeks to provide security fixtures which are aesthetically more acceptable, and a method of manufacturing such fixtures.

SUMMARY OF THE INVENTION

One aspect of the invention provides a method of forming a security fixture for a wall structure, the security fixture having an elongate rail and a plurality of palings, the method comprising the steps of:

punching a flat sheet of material to form a plurality of flat, intermediate-paling members transversely located side-by-side each other in a complementary fit, each of the intermediate-paling members having (i) a longitudinal axis about which the intermediate-paling member is symmetrical;

(ii) a relatively sharp first axial end; and (iii) a relatively blunt second axial end;

cutting the blunt end of each intermediate-paling member along its longitudinal axis from an edge of the intermediate-paling member to form opposite blunt end portions therein;

bending the intermediate-paling members about their longitudinal axes to form a plurality of paling members having v-shaped transverse cross sections; and splaying the blunt end portions of each paling member outwardly to form splayed end portions lying in a common plane perpendicular to the longitudinal axis of the paling member; and connecting the splayed end portions of the paling members to the rail.

Another aspect of the invention provides A security fixture for a wall structure having a top edge, the security fixture comprising:

an elongate rail; and a plurality of elongate palings connected to, spaced apart along and extending perpendicular to the rail, each paling including (i) a longitudinal axis about which the paling is symmetrical, (ii) a first axial end connected to the rail, and (iii) a second, relatively sharp axial end; wherein each paling is bent about its longitudinal axis from an intermediate flat state, into a v-shape;

the first axial end of each paling includes outwardly splayed end portions lying in a common plane perpendicular to the longitudinal axis of the paling, the splayed end portions of the paling being connected to the rail; and the palings are shaped so that, when they are in their intermediate flat state prior to being bent, and the palings are transversely located adjacent each other with alternating palings extending in opposite longitudinal directions, the palings complimentarily fit together.

BRIEF DESCRIPTION OF THE DRAWINGS

FIG. 1 shows an exploded plan view of a precast wall fitted with a security fixture according to a first embodiment of the invention;

FIG. 2 shows a view in elevation of the arrangement of FIG. 1;

FIG. 3 shows a view in elevation of a second embodiment in use on a precast wall;

FIG. 4 shows a section at the line 4—4 in FIG. 3;

FIG. 9 shows a sectional view of a fixture according to a fifth embodiment in use on a precast wall;

FIG. 10 shows a perspective view of a modified fixture;

FIG. 11 illustrates how paling can be punched from sheet metal;

FIG. 12 shows a perspective view of a paling before secural thereof to a rail;

FIG. 13 shows how the paling of FIG. 12 can be secured to a rail to form a fixture according to the invention; and FIG. 14 shows a partial underplan view of the fixture which results from secural of the paling on FIG. 12 to a rail in the manner illustrated in FIG. 13.

DESCRIPTION OF PREFERRED EMBODIMENTS

Figure 5:
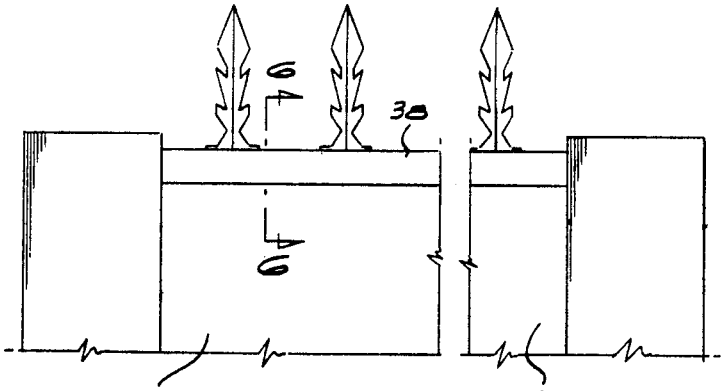
FIG. 5 shows a view in elevation of a third embodiment in use on a precast wall.

Referring to FIGS. 1 and 2, there is shown a portion of a precast wall with two vertical precast posts 10 having vertical grooves 12 and the uppermost lateral precast panel 14. When assembled, the vertical edges of the panel 14 and of those panels below it, are slipped into the vertical grooves 12 and grouted in position.

The panel 14 is fitted with a fixture 16 according to the invention. The fixture 16 includes a metal rail 18 which rests along the top edge of the panel 14. The rail has small tranverse lips 20 which overhang the upper edge of the panel 14 slightly, and it carries a series of palings 22 spot-welded or otherwise fixed to its upper surface at about 100mm centres. The nature of palings is described in greater detail with reference to FIGS. 11 and 12.

The extreme ends of the rail 18 are bent over to provide two transversely extending tabs 26 which overhang the vertical edges of the panel 14. Each of the tabs is formed, e.g. by punching, to have a series of sharp barbs 28. When the precast wall is erected, the tabs 26 are sandwiched between the bases of the vertical grooves 12 and the vertical edges of the panel 14. Grout is then introduced into the remaining space in the grooves 12. When the grout sets around the barbs 28, the rail is permanently fixed in position, with the palings 22 serving to discourage anyone from attempting to clamber over the wall.

The embodiment of FIGS. 3 and 4 is suitable for installation on a precast wall which has already been erected. A rail 30 extends along the top edge of the uppermost panel 32. The opposite ends of the rail are bolted to the webs of U-shaped brackets 34 which are arranged to straddle the panel 32 next to the posts 36. The legs of the brackets are drilled at 38 to take bolts or rivets which are passed through the holes and through registering holes drilled in the panel to secure the rail to the panel.

Figure 6:
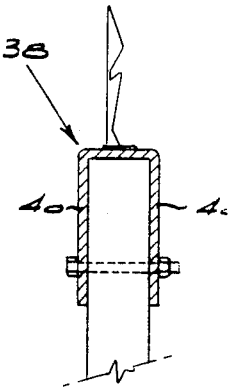
FIG. 6 shows a section at the line 6—6 in FIG. 5.

FIGS. 5 and 6 show an alternative embodiment for use on an already erected precast wall. Here, the rail 38 is U-shaped in cross-section, with legs 40 of substantial length which overhang the uppermost panel 42 when the rail is laid along the top edge of the panel. Holes are drilled through the legs 40 and through the panel 42 to take bolts or rivets which will secure the rail to the panel.

Figure 7:
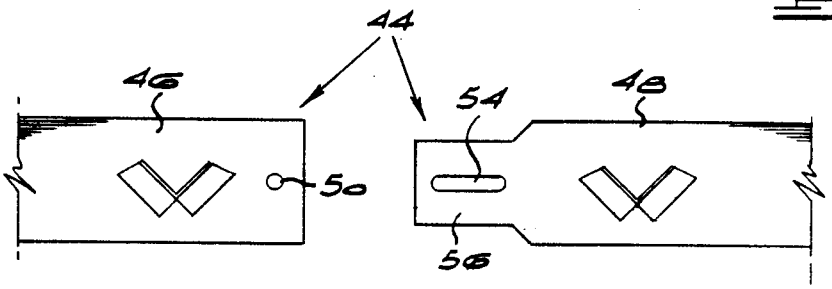
FIG. 7 shows a plan view of a fixture according to a fourth embodiment for use on a brick wall.
Figure 8:
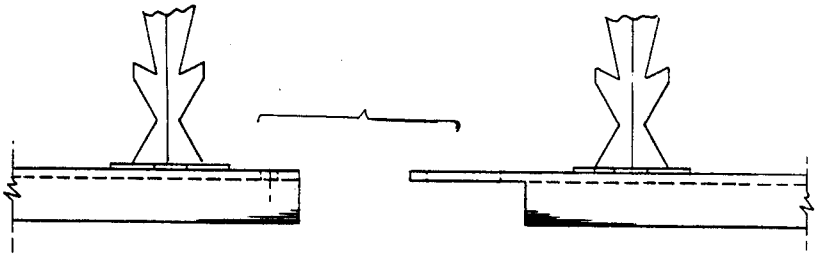
FIG. 8 shows a view in elevation of the fixture of FIG. 7.

The embodiment of FIGS. 7 and 8 is intended for use with an erected brick wall. Here the fixture 44 according to the invention includes a series of interlocking rail sections 46, 48. The rail section 46 has a hole 50 near its end, and the rail section 52 has an elongate slot 54 formed near the end of a protruding tongue 56. During installation, the rail section 46 is laid on the top edge of the wall overlapping the tongue 56, and with the hole 50 and slot 54 in register. A hole is drilled into the top course of bricks beneath the registering hole and slot, and a "Rawlplug" or other masonry engaging bolt is used in various different lengths, with short lengths being suitable when the rail is to follow a bend in the wall.

As a simple alternative to the arrangement described above, it is possible for the rail sections merely to butt up against one another and to have spaced, vertical holes for receiving appropriate fixing means, such as masonry engaging bolts which engage pre-drilled holes in the uppermost course of bricks.

The embodiment of FIG. 9 has a rail 80 which overlaps the upper side edges of the uppermost panel 84 of a precast wall as shown. Spot-welded to the underside of the rail is a series of short lugs 82 having shaped ends, and which are cast into the uppermost panel 84 during the formation of the panel to prevent detachment of the rail from the panel. This embodiment is particularly advantageous in that it can find application both on new precast walls and on already erected walls. In order to fit the rail to an already erected wall, all that need be done is the replacement of the uppermost panels of the walls with panels of the type to which the rails of the type described which have been fitted during the casting process.

Precast panels of the type shown in FIG. 9 can be produced in a simple manner with small modifications to the standard mould which is used for the production of standard panels. Conventionally, standard panels are formed in a mould which is in the form of a shallow, open-topped box. In order to produce panels of the FIG. 9 type, one end of the box is cut away and rebated slightly, and the rail 80 is then arranged at an upright orientation to replace the missing end, with its lugs 82 extending laterally into the interior of the box. Then the box is filled with concrete, which, when it sets, engages the lugs firmly to hold the rail securely onto the panel which is left when the mould is stripped.

The modification of FIG. 10 can be incorporated into any of the previous embodiments, whether on a precast wall or on a brick wall. The upper ends of the palings 90 are provided with aligned holes 92, and a wire 94 is passed through the aligned holes from one end of the wall to the other. This wire is then attached to an appropriate device which will be actuated to initiate the audible alarm of a standard house alarm system if any attempt should be made to bend the palings out of the way to facilitate access over the wall.

In each case, the rail and palings are formed of steel and can be treated to prevent corrosion. For example the rail/paling combination can be powder-coated, galvanised or cadmium plated, or can be of stainless steel.

FIG. 12 shows a preferred paling which is used in all the embodiments described above. The paling 58 has the jagged shape illustrated, and is folded about a vertical axis 60 to provide it with greater resistance to bending forces. The base of the paling has two laterally extending tabs 62 which can be spot welded or otherwise fixed to the rail, so that the paling protrudes normally from the rail.

FIG. 11 shows how a series of flat, intermediate palings 64, 66, 68, 70, 72 can be punched in a single operation from a single flat steel sheet 74 without material wastage.

As illustrated in FIG. 11, the punching die also forms small cut lines 80 which extend along the longitudinal, operatively vertical axes 60 of each intermediate paling 64 to 72. The intermediate palings 64 to 72 which result from the punching operation are subsequently folded about the axes 60 and the tabs 62 are outwardly splayed from the cut lines 80 to form the palings 58 of FIG. 12. Clearly, the resultant palings have V-shaped transverse cross-sections with each leg of the V-shape having an outwardly splayed tab 62.

In each of the embodiments of FIGS. 1 to 10, the palings 58 are secured to the rail by spot-welding or otherwise fixing the tabs 62 to the upper surface of the rail. While this arrangement operates well in practice it may be preferable in some cases to provide a more secure form of attachment between the palings and the rail.

FIG. 13 illustrates an alternative mode of secural of a paling to a rail. The rail is, in this case, formed with a series of spaced, V-shaped slots 82 which correspond in shape to the cross-section of a paling. To secure the paling to the rail, the paling is fed upwardly through the slot until such time as the tabs 62 about the underside of the rail. The tabs are then projection-welded or otherwise fixed to the rail, the result being illustrated in the underplan view of FIG. 14. With this arrangement it will be appreciated that there is a secure connection between each paling and the rail.

While a number of slightly different embodiments of security fixture have been described above, as well as a number of different modes of attachment of the fixture to a wall of brick or precast type, it will be appreciated that there are many other ways in which the fixture can be attached to a wall. In the case of a precast wall, for instance, the ends of the rail can have transverse plates welded thereto, the plates having holes through which masonry engaging bolts can be passed horizontally into the vertical posts to secure the rail in position.

In the case of a brick wall, holes 84 can be formed in the rail to take fixing bolts or the like to the uppermost course of bricks.

I claim:

1. A security fixture for wall structure having a top edge, the security fixture comprising:

an elongate rail; and a plurality of elongate palings connected to, spaced apart along and extending perpendicular to the rail, each paling including (i) a longitudinal axis about which the paling is symmetrical (ii) a first axial end connected to the rail, and (iii) a second, relatively sharp axial end; wherein each paling is bent about its longitudinal axis from an intermediate flat state, into a v-shape; the first axial end of each paling includes a pair of splayed end tabs bent outwardly through substantially 90 degrees relative to the longitudinal axis of the paling member and lying in a common plane perpendicular to the longitudinal axis of the paling, the splayed end tabs of the paling being connected to the rail; and the palings are shaped so that, when they are in their intermediate flat state prior to being bent, and the palings are transversely located adjacent each other with alternating palings extending in opposite longitudinal directions, the palings complementarily fit together.

2. A security fixture according to claim 1, wherein:

the rail is channel shaped in cross-section, including (i) a horizontal web portion having first and second longitudinal edges, and (ii) first and second lips respectively depending downward from and along the first and second longitudinal edges of the web portion;

the rail is adapted to lie along a top edge of the wall structure and to be fastened thereto; and the splayed end portions of the palings are connected to the web portion of the rail.

3. A security fixture according to claim 2, wherein the splayed end portions of the paling are connected to the operatively upper surface of the web portion of the rail.

4. A security fixture according to claim 2, wherein the splayed end portions of the paling are connected to an operatively lower surface of the web portion of the rail.

5. A security fixture according to claim 4, wherein the paling extends through a V-shaped slot in the web portion of the rail, wherein the splayed end portions abut the operatively lower surface of the rail and wherein the splayed end portions are connected to that operatively lower surface.

6. A security fixture according to claim 1, wherein:

each paling includes a main body portion having a top end forming the sharp axial end of the paling, and a bottom terminal edge; and the splayed end tabs of each paling are connected to and extend outward from the bottom terminal edge of the main body portion of the paling.

7. A method of forming a security fixture for a wall structure, the security fixture having an elongate rail and a plurality of palings, the method comprising the steps of:

punching a flat sheet of material to form a plurality of flat, intermediate-paling members transversely located side-by-side each other in a complementary fit, each of the intermediate-paling members having (i) a longitudinal axis about which the intermediate-paling member is symmetrical;

(ii) a relatively sharp first axial end; and (iii) a relatively blunt second axial end;

cutting the blunt end of each intermediate-paling member along its longitudinal axis from an edge of the intermediate-paling member to form opposite blunt end portions therein;

bending the intermediate-paling members about their longitudinal axes to form a plurality of paling members having v-shaped transverse cross sections;

splaying the blunt end portions of each paling member outwardly through substantially 90 degrees to form a pair of end tabs lying in a common plane perpendicular to the longitudinal axis of the paling member; and connecting the end tabs of the paling members to the rail.

8. A method according to claim 7, wherein the punching step includes the step of forming the intermediate-paling members with identical shapes, and with the intermediate-paling members alternatively extended in opposite longitudinal directions.

9. A method according to claim 7, wherein the punching step includes the step of forming each intermediate-paling member with a multitude of projections and recesses, with a plurality of the projections of a first of each pair of adjacent intermediate-paling members complementarily extending into and completely filling a plurality of the recesses of a second of the pair of intermediate-paling members.

10. A method according to claim 7, wherein:

the rail is channel-shaped in cross section and includes (i) a horizontal web portion having a first and second longitudinal edges, and (ii) first and second lips respectively depending downwardly from the first and second longitudinal edges of the web portion, the rail is adapted to lie along a top edge of the wall structure and to be fastened thereto; the splayed end portions of the palings are connected to the web portion of the rail, and the palings are spaced along and vertically extend outward from the rail.

11. A method according to claim 10 wherein the splayed end portions of the palings are connected to an operatively upper surface of the web portion of the rail.

12. A method according to claim 10, wherein the splayed end portions of the palings are connected to an operatively lower surface of the web portion of the rail.

13. A method according to claim 12 wherein the palings are fed through V-shaped slots in the web portion of the rail until such time as the splayed end portions of the palings abut the operatively lower surface of the rail for secural thereto.

14. A method according to claim 7, wherein said edge is a transversely extending terminal edge of the intermediate-paling member.

15. A method according to claim 14, wherein the cutting step includes the step of cutting the blunt end of each intermediate-paling member on its longitudinal axis.

* * * * *

UNITED STATES PATENT AND TRADEMARK OFFICE

CERTIFICATE OF CORRECTION

PATENT NO. : 4,832,316

DATED : May 23, 1989

INVENTOR(S) : William H. Mincher

It is certified that error appears in the above-identified patent and that said Letters Patent is hereby corrected as shown below:

Column 3, line 30: "used in" should read as --used to bolt the sections to the wall. The sections can be made in--

Column 4, line 46: "62 about" should read as --62 abut--

Column 6, line 22, Claim 8: "alternatively" should read as --alternately--

Signed and Sealed this

Twenty-seventh Day of March, 1990

*Attest:*

JEFFREY M. SAMUELS

*Attesting Officer*

*Acting Commissioner of Patents and Trademarks*